US006231232B1

(12) United States Patent
Warr

(10) Patent No.: US 6,231,232 B1
(45) **Date of Patent: *May 15, 2001**

(54) BAG WITH TEAR-RESISTANT HANDLE

(75) Inventor: Charles J. Warr, High Point, NC (US)

(73) Assignee: Rex International Incorporated, Thomasville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/512,712

(22) Filed: Feb. 24, 2000

Related U.S. Application Data

(63) Continuation of application No. 09/261,986, filed on Mar. 4, 1999, now Pat. No. 6,065,871.

(60) Provisional application No. 60/099,943, filed on Sep. 11, 1998.

(51) Int. Cl.[7] ..... B65D 33/08
(52) U.S. Cl. ..... 383/10; 383/903
(58) Field of Search ..... 383/10, 903

(56) References Cited

U.S. PATENT DOCUMENTS

| | | | | |
|---|---|---|---|---|
| 2,758,782 | | 8/1956 | Mengis . | |
| 3,206,105 | | 9/1965 | Smith . | |
| 3,502,258 | | 3/1970 | Kugler et al. . | |
| 3,732,661 | | 5/1973 | Goldberger et al. . | |
| 4,119,268 | * | 10/1978 | Segura | 383/903 X |
| 4,134,245 | * | 1/1979 | Stella | 383/10 X |
| 4,734,148 | | 3/1988 | Meyer . | |
| 4,867,575 | | 9/1989 | Wood . | |
| 5,338,117 | | 8/1994 | Kucksdorf et al. . | |
| 5,558,438 | * | 9/1996 | Warr | 383/10 |
| 5,567,054 | | 10/1996 | Dalgleish . | |
| 5,593,229 | * | 1/1997 | Warr | 383/10 X |
| 5,611,626 | * | 3/1997 | Warr | 383/10 |
| 6,065,871 | * | 5/2000 | Warr | 383/10 |

FOREIGN PATENT DOCUMENTS

| | | | | |
|---|---|---|---|---|
| 2215913 | * | 10/1973 | (DE) | 383/10 |
| 2633793 | * | 2/1978 | (DE) | 383/10 |
| 1231686 | * | 5/1971 | (GB) | 383/903 |
| 2056947 | * | 3/1981 | (GB) | 383/10 |

* cited by examiner

*Primary Examiner*—Jes F. Pascua
(74) *Attorney, Agent, or Firm*—Adams, Schwartz & Evans, P.A.

(57) ABSTRACT

A bag including first and second walls having joined first and second opposed side edges, a top end edge, a bottom end edge, and two spaced-apart seal lines adjacent the top end edge of the bag, the improvement defined of a tear-resistant, bag-supporting handle defined with the two spaced-apart seal lines. The handle includes a hand-insertion slit defined of a middle slit portion parallel to the top end edge and the bottom end edge of the bag and perpendicular to the side edges of the bag, and two arcuate end slit portions, a first end slit portion situated at a first end of the middle slit portion proximate to the first side edge of the bag and a second end slit portion situated at a second end of said middle slit portion proximate to the second side edge of the bag. The end slit portions each define an arc greater than or equal to 180 degrees and extend greater than or equal to 0 degrees and less than or equal to 45 degrees of arc below the middle slit portion toward the bottom end edge of the bag.

6 Claims, 4 Drawing Sheets

BAG WITH TEAR-RESISTANT HANDLE

This application is a continuation of U.S. patent application Ser. No. 09/261,986, filed on Mar. 4, 1999, now U.S. Pat. No. 6,065,871 which, in turn, relates to U.S. Provisional Patent Application Ser. No. 60/099,943, filed on Sep. 11, 1998, and claims priority to that provisional application.

TECHNICAL FIELD AND BACKGROUND OF THE INVENTION

This invention relates to a bag with a tear-resistant handle. The invention relates particularly to the formation of die-cut handles in heavy-duty bags made from single or multiple polyolefin materials, such as LD, HD, and LLD polyethylene, or other thermoplastic material, as well as other woven or nonwoven, synthetic or non-synthetic materials. Such bags are typically used to package materials such as salt, potting soil, small landscaping rocks, pet food, diapers, and similar materials. While the invention has particular application to bags with a capacity of from 10 to 50 pounds, the principle of the invention is applicable to bags of any size and style.

Conventional, heavy-duty bags of the prior art typically include a die-cut handle with a single lateral opening for receiving the hand of the user. This prior art design distributes the stress imposed on the bag handle to the top end of the bag. Due to the typically heavy weight of these bags and their contents, the force required to lift a bag by its handle when the bag is full or nearly full causes a considerable amount of stress at opposing ends of the handle, and, therefore, on the top end of the bag. In addition, the contents of the bag may jostle and shift while the bag is being carried by the handle such that the contents repeatedly impact the bottom of the bag interior, imposing more stress on the opposing ends of the handle and the top of the bag. These lifting and carrying stresses, especially when repeated, can easily tear the handle away from the top end of the bag, causing premature bag rupture and spillage of the bag contents. Such waste burdens manufacturers, distributors, retailers, and consumers with unnecessary product and packaging replacement and clean-up expenses.

The present invention addresses these and other problems by providing a bag with a die-cut handle that better distributes the load of the bag when carried to resist tearing of the handle. The stresses imposed on the opposite ends of the handle when the bag is lifted by the handle and when the contents of the bag impact the bottom of the bag interior while the bag is being carried by the handle are transferred outwardly towards the sides of the bag rather than perpendicularly upward towards the top end of the bag. Distributing the lifting and carrying forces in this manner increases the life of the handle, thereby increasing the likelihood that the bag will maintain its structural integrity and general utility until it has served its intended purpose. The effect of this improvement over the prior art is a reduction in both the product waste and the packaging waste resulting from bag handle failure.

SUMMARY OF THE INVENTION

Therefore, it is an object of the invention to provide a bag with a handle that resists tearing when the bag is lifted and carried by the handle.

It is another object of the invention to provide a bag with a handle that distributes the load of the bag towards opposing sides of the bag, rather than perpendicularly upwardly towards the top end of the bag.

It is another object of the invention to provide a bag with a handle that, before tearing, withstands a high number of impacts by the bag contents against the bottom of the bag interior when the bag is lifted and carried by the handle.

These and other objects of the present invention are achieved in the preferred embodiments disclosed below by providing a bag with first and second walls having joined first and second opposed side edges, a top end edge, a bottom end edge, and two spaced-apart seal lines adjacent the top end edge of the bag, the improvement comprising a tear-resistant, bag-supporting handle defined within the seal lines. The handle includes a hand-insertion slit defined of a middle slit portion situated parallel to both the top end edge and the bottom end edge of the bag and perpendicular to the side edges of the bag. In addition, the handle includes two arcuate end slit portions, a first end slit portion situated at a first end of the middle slit portion proximate to the first side edge of the bag and a second end slit portion situated at a second end of the middle slit portion proximate to the second side edge of the bag. The end slit portions each define an arc greater than or equal to 180 degrees. Each end slit portion extends greater than or equal to 0 degrees and less than or equal to 45 degrees of arc below the middle slit portion toward the bottom end edge of the bag.

According to one preferred embodiment of the invention, each end slit portion defines an arc equal to 360 degrees that extends 0 degrees of arc below the middle slit portion toward the bottom end edge of the bag.

According to another preferred embodiment of the invention, the arcs enclose spaces with center points measuring 3.50 inches apart.

According to yet another preferred embodiment of the invention, each end slit portion defines an arc equal to 180 degrees that extends 0 degrees of arc below the middle slit portion toward the bottom end edge of the bag.

According to yet another preferred embodiment of the invention, each end slit portion defines an arc greater than 180 degrees and less than or equal to 225 degrees. Each arc extends greater than 0 degrees and less than or equal to 45 degrees of arc below the middle slit portion toward the bottom end edge of the bag.

According to one preferred embodiment of the invention, a bag is provided with first and second walls having joined first and second opposed side edges, a top end edge, a bottom end edge, and two spaced-apart seal lines adjacent the top end edge of the bag, the improvement comprising a tear-resistant, bag-supporting handle defined within the seal lines. The handle includes a hand-insertion slit defined of a first end and a second end measuring 3.50 inches apart and a middle slit portion situated parallel to both the top end edge and the bottom end edge of the bag and perpendicular to the side edges of the bag. In addition, the handle includes two arcuate end slit portions, a first end slit portion situated at a first end of the middle slit portion proximate to the first side edge of the bag and a second end slit portion situated at a second end of the middle slit portion proximate to the second side edge of the bag. The end slit portions each define an arc greater than or equal to 180 degrees. Each end slit portion extends greater than or equal to 0 degrees and less than or equal to 45 degrees of arc below the middle slit portion toward the bottom end edge of the bag.

According to one preferred embodiment of the invention, a bag is provided with first and second walls having joined first and second opposed side edges, a top end edge, a bottom end edge, and two spaced-apart seal lines adjacent the top end edge of the bag, the improvement comprising a tear-resistant, bag-supporting handle defined within the seal lines. The handle includes a hand-insertion slit defined of a middle slit portion situated parallel to both the top end edge and the bottom end edge of the bag and perpendicular to the side edges of the bag. In addition, the handle includes two arcuate end slit portions, a first end slit portion situated at a first end of the middle slit portion proximate to the first side edge of the bag and a second end slit portion situated at a second end of the middle slit portion proximate to the second side edge of the bag. The end slit portions each define an arc equal to 360 degrees. Each end slit portion extends 0 degrees of arc below the middle slit portion toward the bottom end edge of the bag.

According to another preferred embodiment of the invention, each arc has a diameter of 0.5 inches.

According to yet another preferred embodiment of the invention, a first end of the slit and a second end of the slit are 3.50 inches apart.

According to yet another preferred embodiment of the invention, each arc has a radius of 0.38 inches and forms an inner arc with the middle slit portion, each inner arc having a radius of 0.25 inches.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
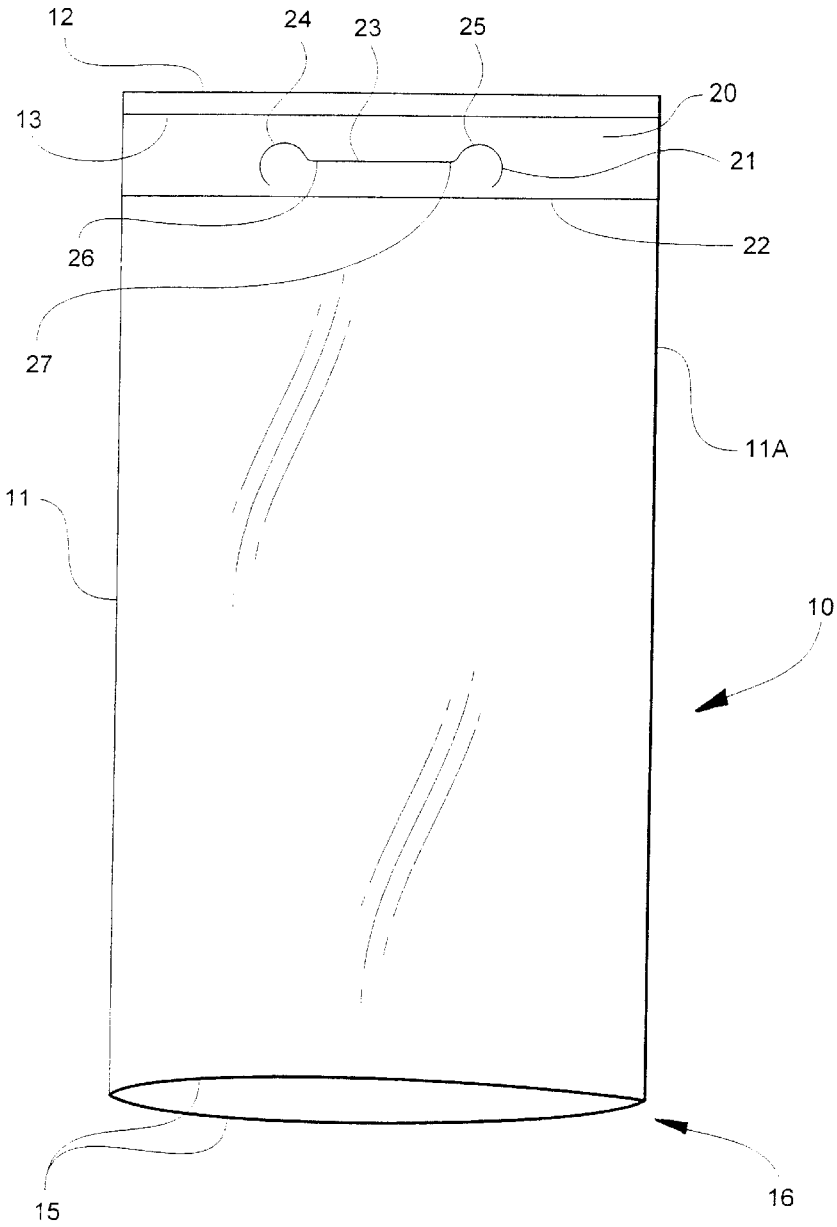
FIG. 1 illustrates one preferred embodiment of the bag.

Referring now specifically to the drawings, a bag according to a preferred embodiment of the invention is illustrated broadly at reference numeral 10 in FIG. 1.

The bag 10 is of a type intended for heavy-duty applications, and is fabricated from a polyolefin sheet or tube stock such as polyethylene having a thickness in the range of 2 to 12 mils. The sheet or tube stock may be coextruded or monoextruded, and may be single ply or multi-ply material. The multi-ply material may be multiple thicknesses of the same sheet or tube stock, or different materials to provide particular characteristics, such as strength, flexibility, UV resistance, or color. The sheet stock may also be woven or non-woven synthetic or non-synthetic material.

The bag 10 includes overlying walls defining opposed, joined side edges 11 and 11A, a top end edge 12, and a bottom end edge 15. The term "joined" as used herein is used in its broad sense to mean either two formerly separate sheets connected together, or integrally formed by, for example, folding over a sheet to define an edge.

Preferably, the top end edge 12 of the bag 10 is closed by a top elongate seal line 13 formed by an adhesive, sewing, ultrasonic heating, or other heat-fusing process connecting the thermoplastic walls together along a narrow, straight line. The bottom end edge 15 of the bag 10 remains open for filling. Once filled, the bottom end edge 15 is closed to form a bottom 16 of the bag 10.

A handle 20 is formed in the bag 10 by cutting a slit 21 with a predetermined shape in the bag 10 at a spaced-apart distance from the top end edge 12 and the top elongate seal line 13. To prevent the contents of the bag 10 from spilling out through the handle 20, a bottom elongate seal line 22 is formed by an adhesive, sewing, ultrasonic heating, or other heat-fusing process connecting the thermoplastic walls of the bag 10 together along a narrow, straight line at a spaced-apart distance below the slit 21. The handle 20 is cut to receive one or both hands of a user carrying the bag 10.

The slit 21 includes a middle slit portion 23 parallel to the top end edge 12 and the bottom end edge 15 of the bag 10 and perpendicular to the side edges 11 and 11A of the bag 10. The slit 21 also includes a first end slit portion 24 situated at a first end 26 of the middle slit portion 23 proximate to the first side edge 11 of the bag 10 and a second end 27 of the middle slit portion 23 proximate to the second side edge 11A of the bag 10. Each of the end slit portions 24 and 25 define an arc greater than or equal to 180 degrees. Furthermore, each end slit portion 24 or 25 extends greater than or equal to 0 degrees and less than or equal to 45 degrees of arc below the middle slit portion 23 toward the bottom end edge 15 of the bag 10.

Figure 2:
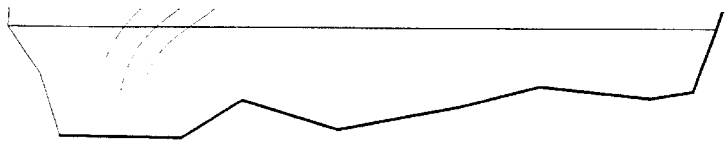
FIG. 2 is an enlarged, fragmentary view of a bag with a handle formed according to one preferred embodiment of the invention.
Figure 2A:
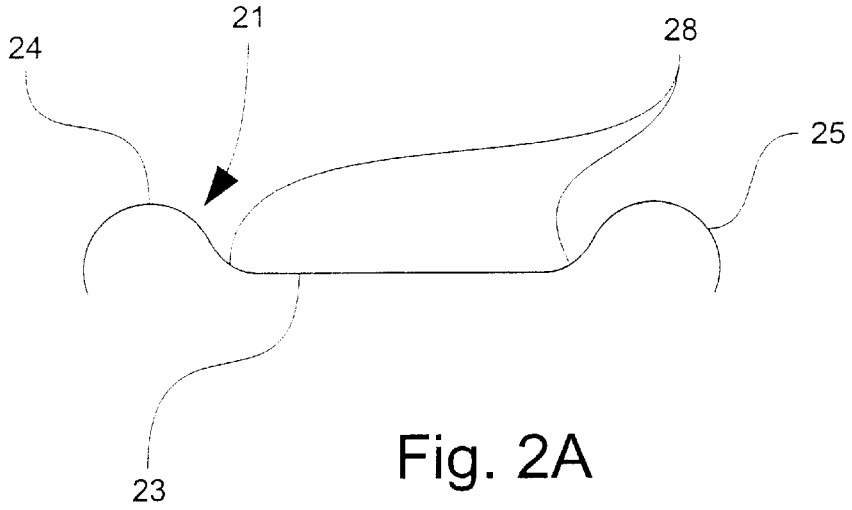
FIG. 2A is a detail of the shape of the bag handle formed as shown in FIG. 2.
Figure 2:
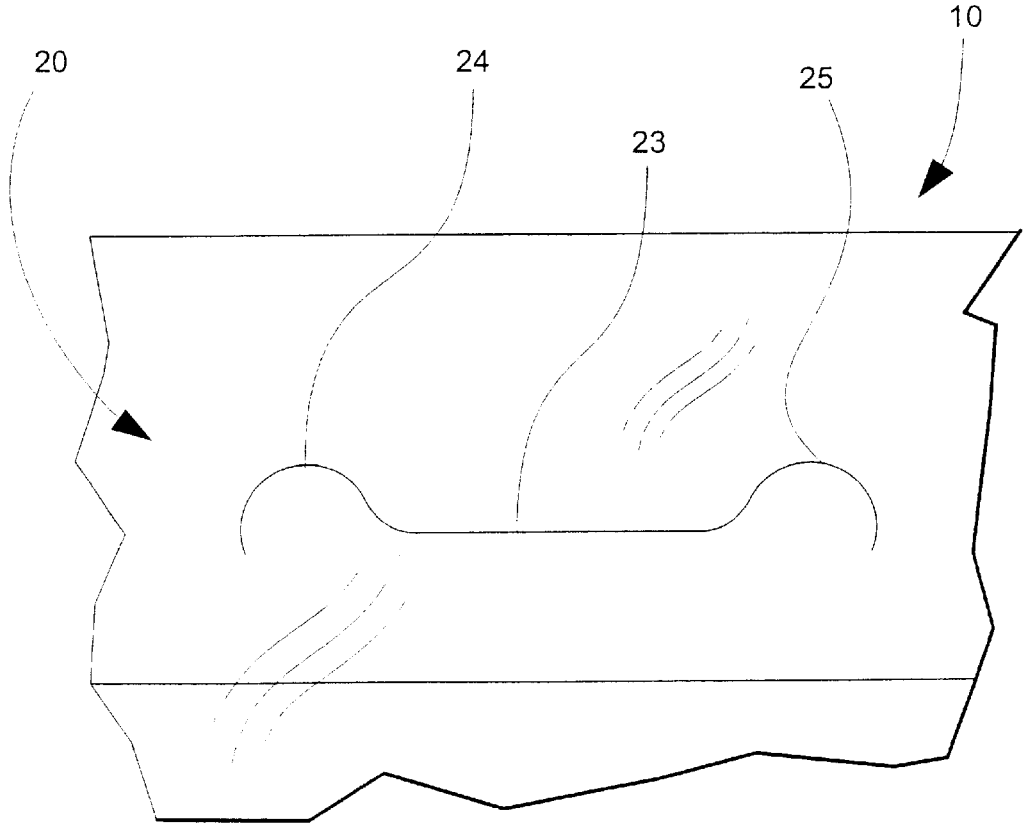
Figure 3A:
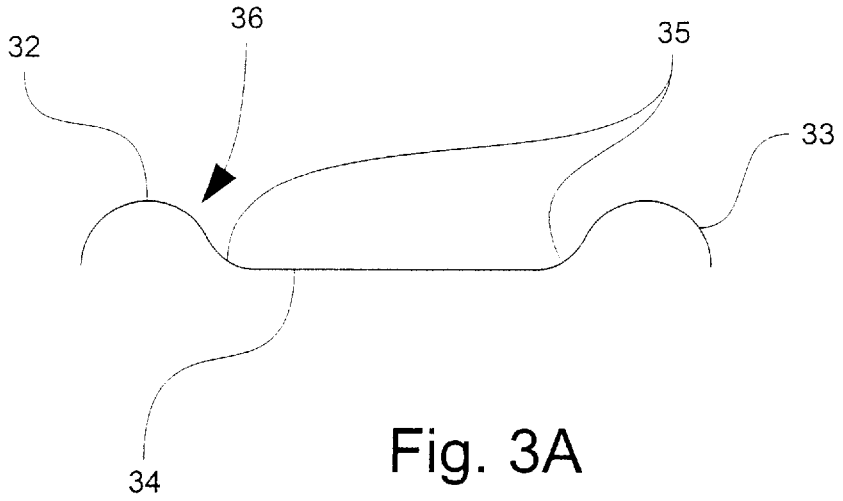
FIG. 3A is a detail of the shape of the bag handle formed as shown in FIG. 3.
Figure 3:
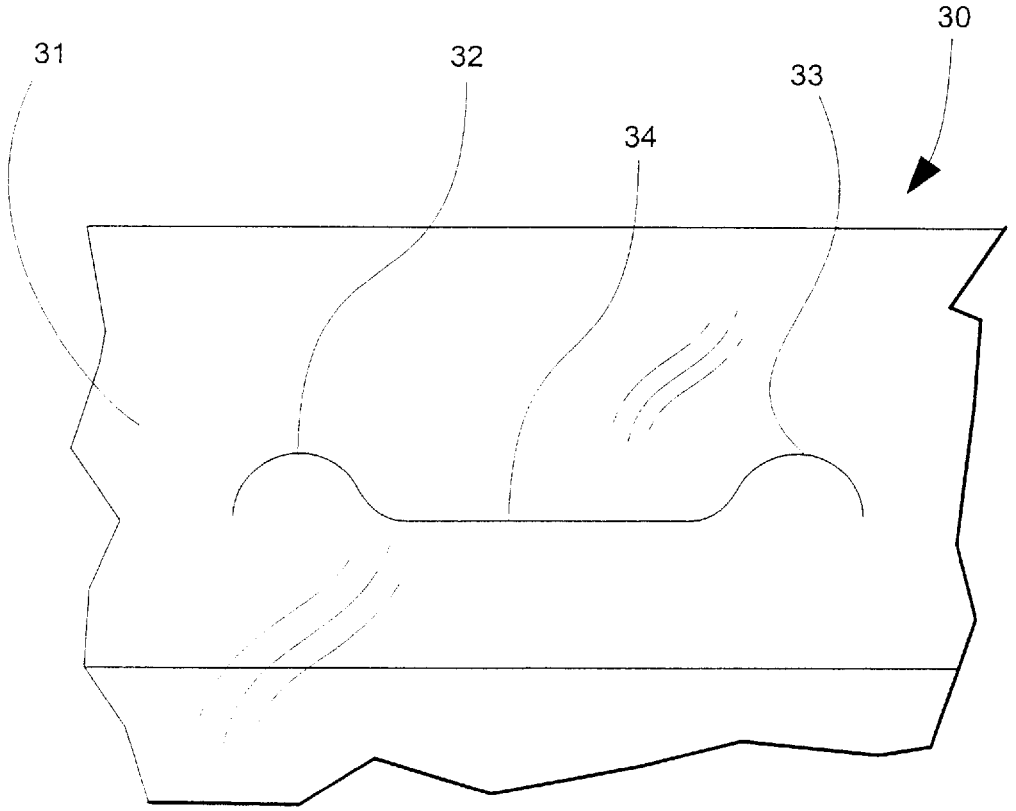
FIG. 3 is an enlarged, fragmentary view of a bag with a handle according to a second preferred embodiment of the invention.
Figure 4A:
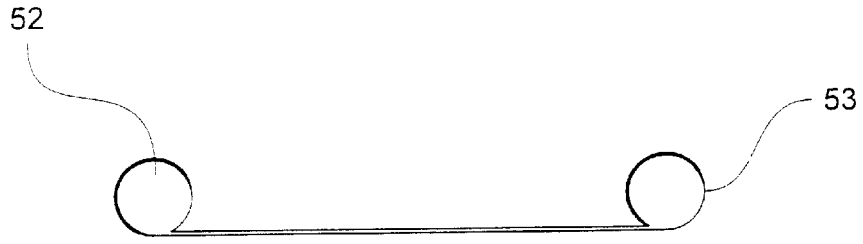
FIG. 4A is a detail of the shape of the bag handle formed as shown in FIG. 4.
Figure 4:
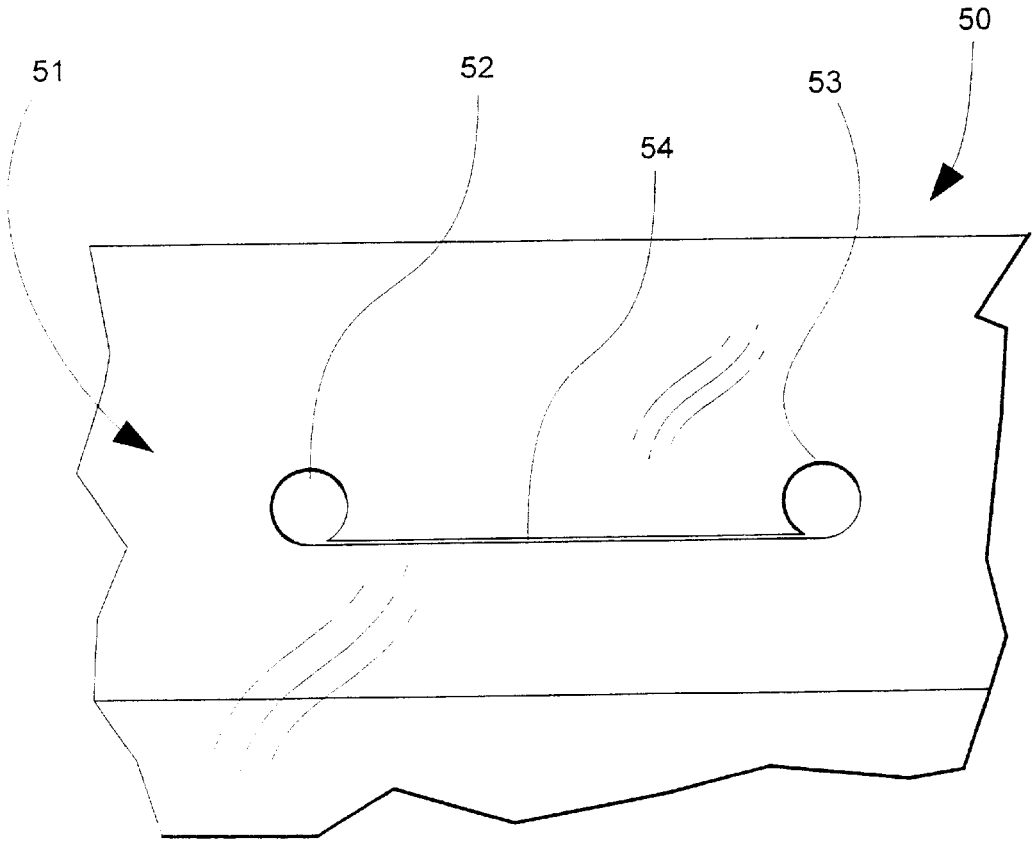
FIG. 4 is an enlarged, fragmentary view of a bag with a handle according to a third preferred embodiment of the invention.

FIGS. 2, 3, and 4 illustrate improved bag handles according to the present invention that include the slit shapes respectively illustrated in FIGS. 2A, 3A, and 4A. The strength of each handle has been tested using a mechanical, motorized, cam-actuated jolt tester. The jolt tester includes an extended metal arm adapted to simulate the arm of a user holding a filled bag by the handle. After filling the bag and suspending it by the handle from the metal arm, the cam motor was actuated to create an upwardly jolting motion on the handle. An electric eye that was connected to the cam motor and focused on the bag handle stopped the motor when the handle tore. An automatic counter counted the number of jolts sustained by the handle prior to tearing. The test results for each of the bags shown in FIGS. 2, 3, and 4 as well as the test results for bags with prior art handle slit shapes are provided in the following table.

JOLT TEST RESULTS FOR VARIOUS BAG HANDLE DESIGNS

| Bag Handle Slit Shape and Reference | Number of Jolts Sustained Before Tearing |
|---|---|
| (Present Invention-FIGS. 2 and 2A) | 45 |
| (Present Invention-FIGS. 3 and 3A) | 32 |
| (Present Invention-FIGS. 4 and 4A) | 33 |
| (Prior Art-U.S. Pat. No. 3,732,661) | 40 |
| (Prior Art-U.S. Pat. No. 3,732,661) | 24 |
| (Prior Art- | 15 |

-continued

JOLT TEST RESULTS FOR VARIOUS BAG HANDLE DESIGNS

| Bag Handle Slit Shape and Reference | Number of Jolts Sustained Before Tearing |
|---|---|
| U.S. Pat. No. 3,502,258, U.S. Pat. No. 4,867,575, and U.S. Pat. No. 5,567,054) (Prior Art- U.S. Pat. No. 5,538,438, U.S. Pat. No. 5,593,229, and U.S. Pat. No. 5,611,626) | 8 |

As the above table indicates, preferred embodiments of the present invention include three of the four most tear-resistant handles tested using the jolt mechanism. One preferred embodiment of the invention, illustrated in FIGS. 1, 2, and 2A, includes the most tear-resistant handle 20 tested, sustaining 45 jolts before tearing, over five times the 8 jolts sustained by the least tear-resistant handle tested. The second preferred embodiment of the invention, illustrated in FIGS. 3 and 3A, includes the handle 31 that sustained 32 jolts before tearing. The third preferred embodiment of the invention, illustrated in FIGS. 4 and 4A, includes the handle 51 that sustained 33 jolts before tearing. Thus, all three preferred embodiments of the invention improve on the tear resistance of prior art bag handles.

FIGS. 2 and 2A show enlarged, fragmentary views of the preferred embodiment of the invention shown broadly in FIG. 1. The end slit portions 24 and 25 of the handle 20 each define an arc greater than 180 degrees and less than or equal to 225 degrees; specifically, the end slit portions 24 and 25 each measure approximately 202 degrees of arc. Each end slit portion 24 or 25 in this preferred embodiment extends greater than 0 degrees and less than or equal to 45 degrees of arc below the middle slit portion 23; specifically, the end slit portions 24 and 25 each extend approximately 22 degrees of arc below the middle slit portion 23. As shown the detail illustrated in FIG. 2A, the end slit portions 24 and 25 in this preferred embodiment each have a radius of approximately 0.38 inches. The inner arcs 28 formed by the intersections of the middle slit portion 23 and the end slit portions 24 and 25 each have a radius of approximately 0.25 inches. The slit 21 measures approximately 3.50 inches at its longest point.

FIGS. 3 and 3A show a second preferred embodiment of the invention, comprising a bag 30 including a handle 31. The end slit portions 32 and 33 of the handle 31 each define an arc of 180 degrees. Each end slit portion 32 or 33 in this preferred embodiment extends 0 degrees below the middle slit portion 34. As shown in the detail illustrated in FIG. 3A, the end slit portions 32 and 33 in this preferred embodiment each have a radius of approximately 0.38 inches. The inner arcs 35 formed by the intersections of the middle slit portion 34 and the end slit portions 32 and 33 each have a radius of approximately 0.25 inches. The slit 36 measures approximately 3.50 inches at its longest point.

FIGS. 4 and 4A show a third preferred embodiment of the invention, comprising a bag 50 including a handle 51. The end slit portions 52 and 53 of the handle 51 each define an arc of 360 degrees. Each end slit portion 52 or 53 in this preferred embodiment extends 0 degrees below the middle slit portion 54. As shown in the detail illustrated in FIG. 4A, the end slit portions 52 and 53 in this preferred embodiment each have a diameter of approximately 0.5 inches. The center points of the spaces defined by the end slit portions 52 and 53 are approximately 3.50 inches apart.

A bag with a tear-resistant handle is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a bag including first and second walls having joined first and second opposed side edges, a top end edge, a bottom end edge, and two spaced-apart seal lines adjacent the top end edge of the bag, the improvement comprising a tear-resistant, bag-supporting handle defined within said two spaced-apart seal lines, said handle comprising a hand-insertion slit defined of a middle slit portion parallel to the top end edge and the bottom end edge of the bag and perpendicular to the side edges of the bag, and two arcuate end slit portions, a first end slit portion situated at a first end of said middle slit portion proximate to the first side edge of the bag and a second end slit portion situated at a second end of said middle slit portion proximate to the second side edge of the bag, said end slit portions each defining an arc greater than or equal to 180 degrees, each end slit portion extending greater than 0 degrees and less than or equal to 45 degrees of arc below the middle slit portion toward the bottom end edge of the bag.

2. A bag according to claim 1, wherein the arcs defined by the end slit portions are each greater than 180 degrees and less than or equal to 225 degrees and each arc extends greater than 0 degrees and less than or equal to 45 degrees of arc below the middle slit portion toward the bottom end edge of the bag.

3. A bag according to claim 2, wherein the arcs defined by the end slit portions are each approximately 202 degrees and extend approximately 22 degrees of arc below the middle slit portion toward the bottom end edge of the bag.

4. A bag according to claim 2, wherein a first end of the slit and a second end of the slit are 3.50 inches apart.

5. In a bag including first and second walls having joined first and second opposed side edges, a top end edge, a bottom end edge, and two spaced-apart seal lines adjacent the top end edge of the bag, the improvement comprising a tear-resistant, bag-supporting handle defined within said two spaced-apart seal lines, said handle comprising a hand-insertion slit defined of a first end and a second end measuring 3.5 inches apart, a middle slit portion parallel to the top end edge and the bottom end edge of the bag and perpendicular to the first and second opposed side edges of the first and second walls of the bag, and two arcuate end slit portions, a first end slit portion situated at an end of said middle slit portion proximate to the first side edge of the bag and a second end slit portion situated at an end of said middle slit portion proximate to the second side edge of the bag, said end slit portions each defining an arc greater than or equal to 180 degrees, each end slit portion extending greater than 0 degrees and less than or equal to 45 degrees of arc below the middle slit portion toward the bottom end edge of the bag.

6. A bag according to claim 5, wherein the arcs defined by the end slit portions are each approximately 202 degrees and extend approximately 22 degrees of arc below the middle slit portion toward the bottom end edge of the bag.

* * * * *